US008696372B2

(12) United States Patent
Endo et al.

(10) Patent No.: US 8,696,372 B2
(45) Date of Patent: Apr. 15, 2014

(54) TERMINAL HAVING FIRST AND SECOND CONTACT PARTS OF DIFFERENT LENGTHS AND WIDTHS CONNECTED TO TWO SIDES OF A PRINTED CIRCUIT BOARD

(75) Inventors: Takayoshi Endo, Shizuoka (JP); Masaya Muta, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 13/585,019

(22) Filed: Aug. 14, 2012

(65) Prior Publication Data

US 2013/0045636 A1 Feb. 21, 2013

(30) Foreign Application Priority Data

Aug. 18, 2011 (JP) ..... 2011-178721

(51) Int. Cl.
*H01R 13/15* (2006.01)

(52) U.S. Cl.
USPC ..... 439/260

(58) Field of Classification Search
USPC ..... 439/59, 60, 260, 265, 629
See application file for complete search history.

(56) References Cited

U.S. PATENT DOCUMENTS 4,343,523 A * 8/1982 Cairns et al. ..... 439/588
5,238,411 A 8/1993 Jinno et al.
5,573,415 A 11/1996 Fujitani et al.
5,924,883 A * 7/1999 Yamagami et al. ..... 439/326
6,644,995 B1 * 11/2003 Jones et al. ..... 439/260
6,932,659 B1 8/2005 Wong
2007/0099514 A1 * 5/2007 Ito ..... 439/660
2008/0272483 A1 * 11/2008 Oman ..... 257/713

FOREIGN PATENT DOCUMENTS

GB 838543 6/1960
JP 5-31139 4/1993
JP 7-142128 6/1995

OTHER PUBLICATIONS

European Search Report (ESR) issued Oct. 8, 2013 in European Patent Application No. EP 12 17 8852.

* cited by examiner

*Primary Examiner* — Chandrika Prasad
(74) *Attorney, Agent, or Firm* — Wenderoth, Lind & Ponack, L.L.P.

(57) ABSTRACT

A terminal connected to a printed circuit board by sandwiching the printed circuit board therebetween includes a first contact part making contact with an upper surface of the printed circuit board, and a second contact part making contact with a lower surface of the printed circuit board, the second contact part being in facing relation with the first contact part, the first contact part including a resilient contact piece making contact with the upper surface, and a support part for supporting the contact piece, the contact piece having a width smaller than a width of the support part, the second contact part having a width smaller than a width of the support part, the contact piece having a length greater than a length of the second contact part, the lengths being measured in a direction perpendicular to a plane defined by the printed circuit board.

15 Claims, 18 Drawing Sheets

Prior Art

Prior Art

Prior Art

Prior Art

TERMINAL HAVING FIRST AND SECOND CONTACT PARTS OF DIFFERENT LENGTHS AND WIDTHS CONNECTED TO TWO SIDES OF A PRINTED CIRCUIT BOARD

BACKGROUND OF THE INVENTION

1. Field of the Invention

The invention relates to a terminal used for electrically connecting an electrically conductive cable with a contact terminal of a printed circuit board, and further to a connector including a plurality of the terminals.

2. Description of the Related Art

There have been suggested various connectors in accordance with purposes thereof for electrically connecting an electrically conductive cable to a contact terminal formed at a marginal area on a printed circuit board. Concerning the present invention, there have been suggested a connector used for a printed board in Japanese Utility Model Application Publication No. 1993-31139, and a card edge connector in Japanese Patent Application Publication No. 1995-142128, for instance.

FIG. 1 is an exploded perspective view of the connector 100 disclosed in Japanese Utility Model Application Publication No. 1993-31139, and FIG. 2 is a longitudinal cross-sectional view of the same.

A connection terminal 110 defining a part of the connector 100 includes vertical walls 102 formed at a front thereof with a slit 101, a resilient contact piece 120 formed at a bottom within the slit 101, and an electrical contact 121 formed at a ceiling within the slit 101 in facing relation with the resilient contact piece 120.

The connection terminal 110 is inserted into a terminal room 131 formed in a connector housing 130. A printed circuit board 140 is sandwiched between the resilient contact piece 120 of the connection terminal 110 and the electrical contact 121 in the terminal room 131 to thereby be electrically connected to the connection terminal 110.

FIG. 3 is an exploded perspective view of the card edge connector 200 disclosed in Japanese Patent Application Publication No. 1995-142128, and FIG. 4 is a cross-sectional view of the same to be connected to a housing.

The card edge connector 200 includes a box-shaped outer housing 210, and two inner housings 220 rotatably supported in the outer housing 210 in facing relation with each other.

The card edge connector 200 is inserted into a housing 230. A printed circuit board 240 is inserted into the housing 230 in a direction opposite to a direction in which the card edge connector 200 is inserted into the housing 230. The printed circuit board 240 is sandwiched between the terminals 221 arranged on inner walls of the inner housings 220 to thereby be electrically connected to the card edge connector 200.

In the connector 100 illustrated in FIGS. 1 and 2 and the card edge connector 200 illustrated in FIGS. 3 and 4, when a plurality of the connection terminals 110 and the terminals 221 are connected to the printed circuit board 140 or 240 along a marginal area thereof, a pitch between the adjacent connection terminals 110 and terminals 221 has to be designed longer than a width of the connection terminals 110 and the terminals 221, resulting in the difficulty to a need of a narrower pitch in the connectors.

Furthermore, though the card edge connector 200 can electrically connect circuits formed on upper and lower surfaces of the printed circuit board 240 to each other, the card edge connector 200 is not designed to include a board receiver. This results in shortage in reliability in the case that the card edge connector 200 is used in an automobile.

Namely, the connection terminal 110 of the connector 100 and the terminal 221 of the card edge connector 200 have to be designed to have a smaller width in order to be arranged at a narrower pitch. However, if they were designed to have a reduced pitch, they would have reduced rigidity, and hence, would have reduced force for sandwiching the printed circuit board 140 or 240 therebetween, with the result of deterioration in contact reliability. Thus, there is a limitation in reduction of a width of the connection terminal 110 and the terminal 221.

SUMMARY OF THE INVENTION

In view of the above-mentioned problems in the conventional connectors, it is an object of the present invention to provide a terminal which is capable of being arranged at a narrow pitch, and providing adequate contact reliability.

In one aspect of the present invention, there is provided a terminal to be connected to a printed circuit board by sandwiching the printed circuit board therebetween at upper and lower surfaces of the printed circuit board, including a first contact part making contact with a first contact area formed at an upper surface of the printed circuit board, and a second contact part making contact with a second contact area formed at a lower surface of the printed circuit board, the second contact part being in facing relation with the first contact part, the first contact part including a resilient contact piece making contact with the first contact area, and a support part for supporting the contact piece, the contact piece having a width smaller than a width of the support part, and the second contact part having a width smaller than a width of the support part, the contact piece having a length greater than a length of the second contact part, the lengths being measured in a direction perpendicular to a plane defined by the printed circuit board.

When a plurality of the terminals in accordance with the present invention is arranged in a marginal area of a printed circuit board, it is possible to arrange two terminals within a width of the support part which is a maximum width among the terminal, by alternately arranging the first contact part of a first terminal and the second contact part of a second terminal situated adjacent to the first terminal. Thus, it is possible to reduce a pitch between the first or second contact areas formed on the upper or lower surfaces of a printed circuit board, making it possible to increase a number of the terminals to be connected to a printed circuit board.

For instance, the contact piece may be designed to have either a width equal to a width of the second contact part or a width smaller than a width of the second contact part.

It is preferable that the second contact part has a width smaller than a difference between a width of the support part and a width of the contact piece.

By so designing the contact piece or the second contact part, when two terminals are arranged adjacent to each other, there would be a sufficient space between the second contact part of one of the terminals and the first contact part of the other.

For instance, it is preferable that the second contact part has a width equal to or smaller than a half of a width of the support part.

For instance, the second contact part may be designed to comprise a plurality of plates layered in a plane perpendicular to the printed circuit board.

This ensures the second contact part to have increased rigidity, ensuring enhancement in contact reliability between the terminal and a printed circuit board.

For instance, the contact piece may be designed to be V-shaped, projecting towards the second contact part.

By designing the contact piece V-shaped, the contact piece can surely compress a printed circuit board at a summit thereof.

It is preferable that the terminal further includes a subsidiary spring situated inside of the contact piece for actuating the contact piece towards the second contact part.

By designing the terminal to further include a subsidiary spring, the terminal could have increased force for sandwiching a printed circuit board between the first and second contact parts.

For instance, the subsidiary spring may be designed to be J-shaped.

It is preferable that the second contact part includes at least one contact having an upper surface having a semi-circular cross-section.

By designing the second contact part to have such a contact, it is possible for the second contact part to have enhanced contact-reliability to a printed circuit board.

It is preferable that the terminal further includes a cover covering the first and second contact parts therewith.

It is preferable that the cover makes close contact with the first and second contact parts, and it is particularly preferable that the cover makes surface-contact at least with opposite side surfaces of the second contact part.

By designing the terminal to further include the cover, it is possible to increase a strength of the first and second contact parts, and hence, the first and second contact parts can surely sandwich a printed circuit board therebetween.

It is preferable that the cover includes a first cover portion covering the support part of the first contact part therewith, and a second cover portion covering the second contact part therewith, wherein the second cover portion has a width smaller than a width of the first cover portion, and a portion of the cover covering the contact piece has a width equal to a width of the second cover portion.

By designing the widths of the second cover portion and the portion of the cover covering the contact piece, even when the cover is attached to the terminal, it is possible to arrange two terminals within a width of the first cover portion which is a maximum width in the cover.

It is preferable that the cover includes a first cover portion covering the support part of the first contact part therewith, and a second cover portion covering the second contact part therewith, wherein the second cover portion has a width smaller than a width of the first cover portion, and the second covering portion has a width smaller than a difference between a width of the first cover portion and a width of a portion of the cover covering the contact piece.

For instance, the second cover portion may be designed to have a width smaller than a half of a width of the first cover portion.

It is preferable that a portion of the cover covering the contact piece has a length greater than a length of the second cover portion the lengths being measured in a direction perpendicular to a plane defined by the printed circuit board.

It is preferable that the terminal further includes a cable compressive section in which a cable is held in a compressed condition in a width-wise direction of the support part.

By designing the terminal to further include the cable compressive section, it is possible to lower a height at which the terminal is fixed in a step such as a step for connecting the terminal to a printed circuit board, ensuring enhancement of workability.

In another aspect of the present invention, there is provided a connector including a terminal as set forth above, and a housing including therein a plurality of the terminals.

By arranging a plurality of the terminals in accordance with the present invention in a housing, and simultaneously connecting the terminals to a printed circuit board, since the terminals are arranged at a smaller pitch than the conventional connectors, it is possible to connect a greater number of the terminals to a printed circuit board.

The above-mentioned present invention provides the advantages as follows.

The terminals in accordance with the present invention can be arranged at a smaller pitch than the conventional connectors, and can provide adequate contact reliability to a printed circuit board.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1:
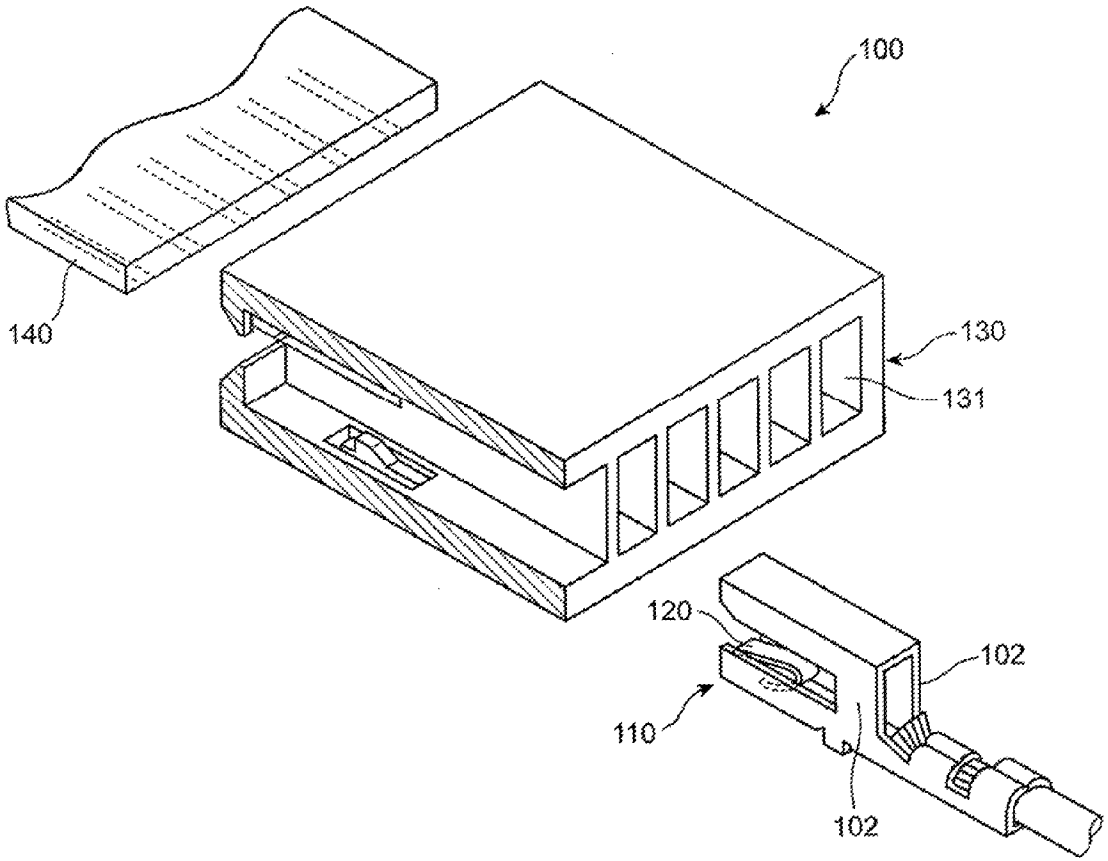
FIG. 1 is an exploded perspective view of the conventional connector to be connected to a printed circuit board.
Figure 2:
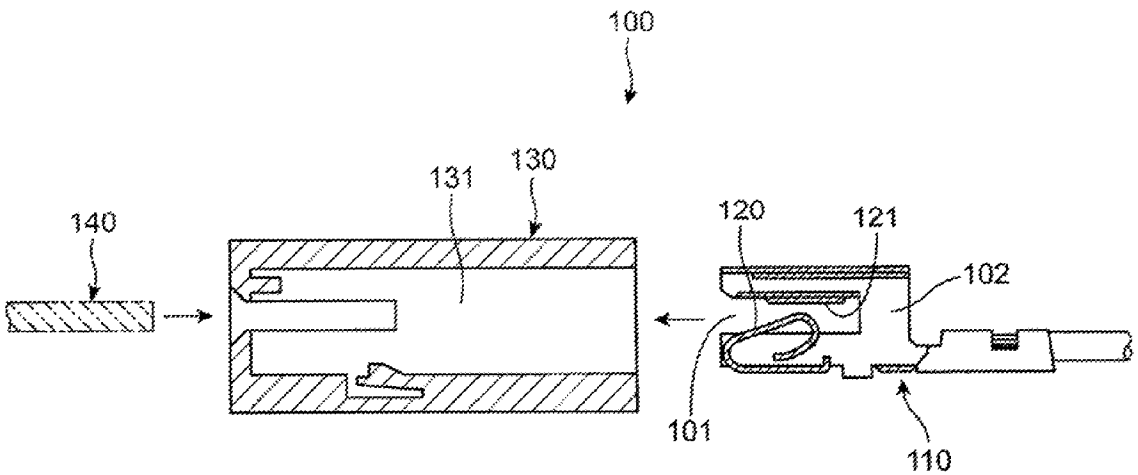
FIG. 2 is a longitudinal cross-sectional view of the conventional connector illustrated in FIG. 1.
Figure 3:
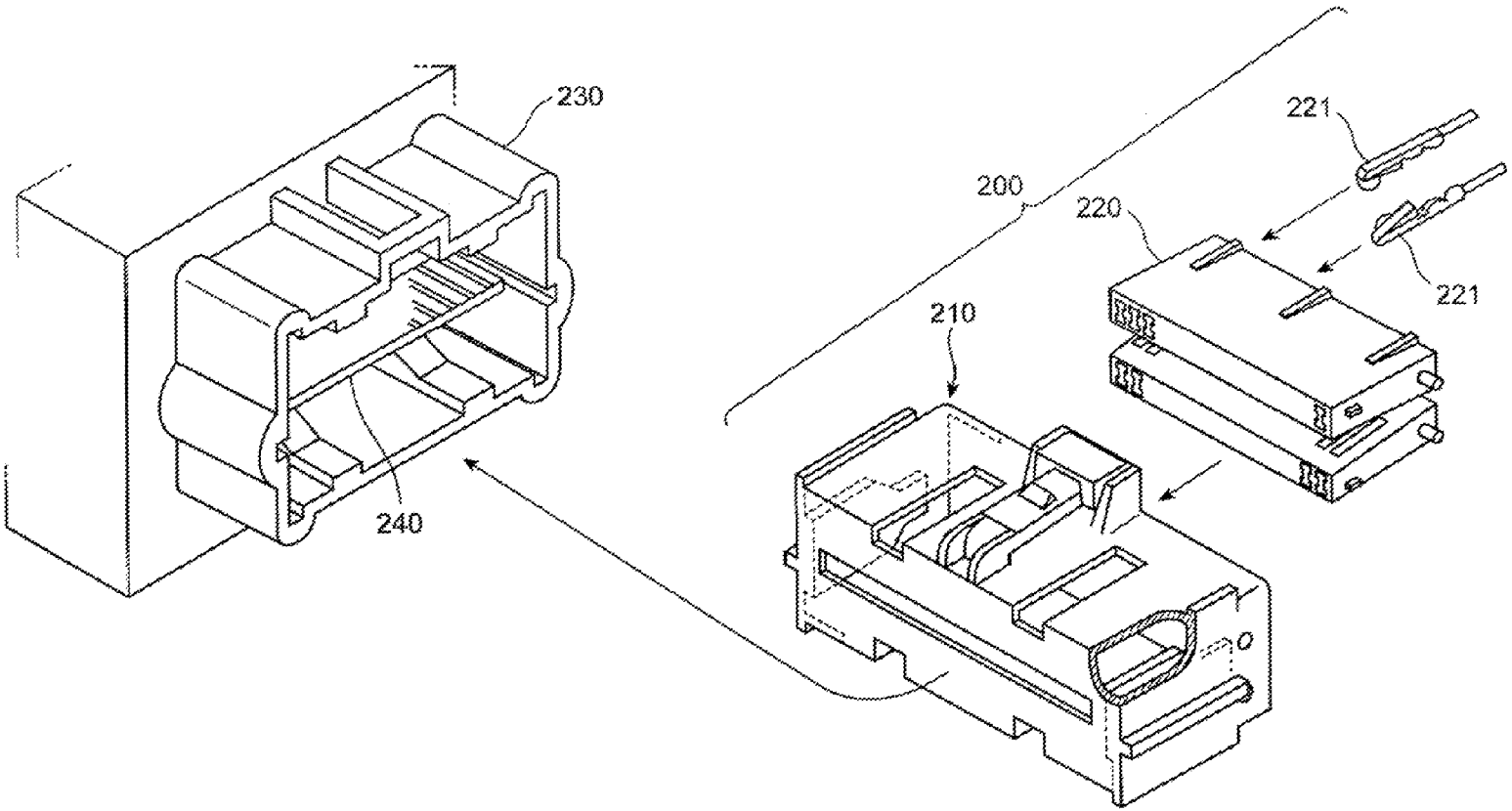
FIG. 3 is an exploded perspective view of the conventional card edge connector.
Figure 4:
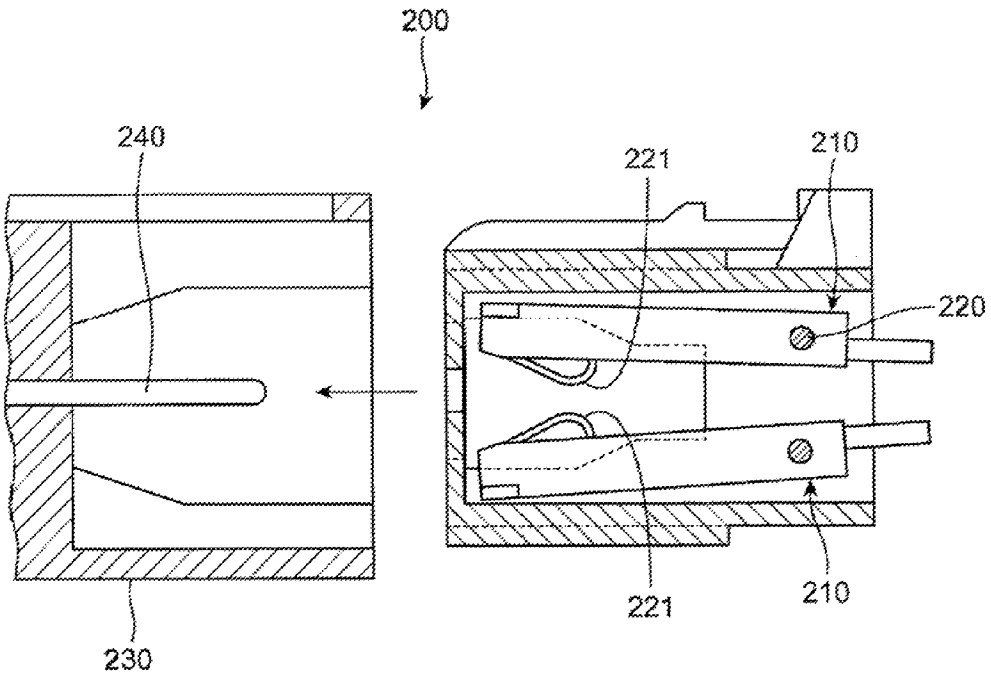
FIG. 4 is a cross-sectional view of the conventional card edge connector illustrated in FIG. 3 to be connected to a housing.
Figure 5:
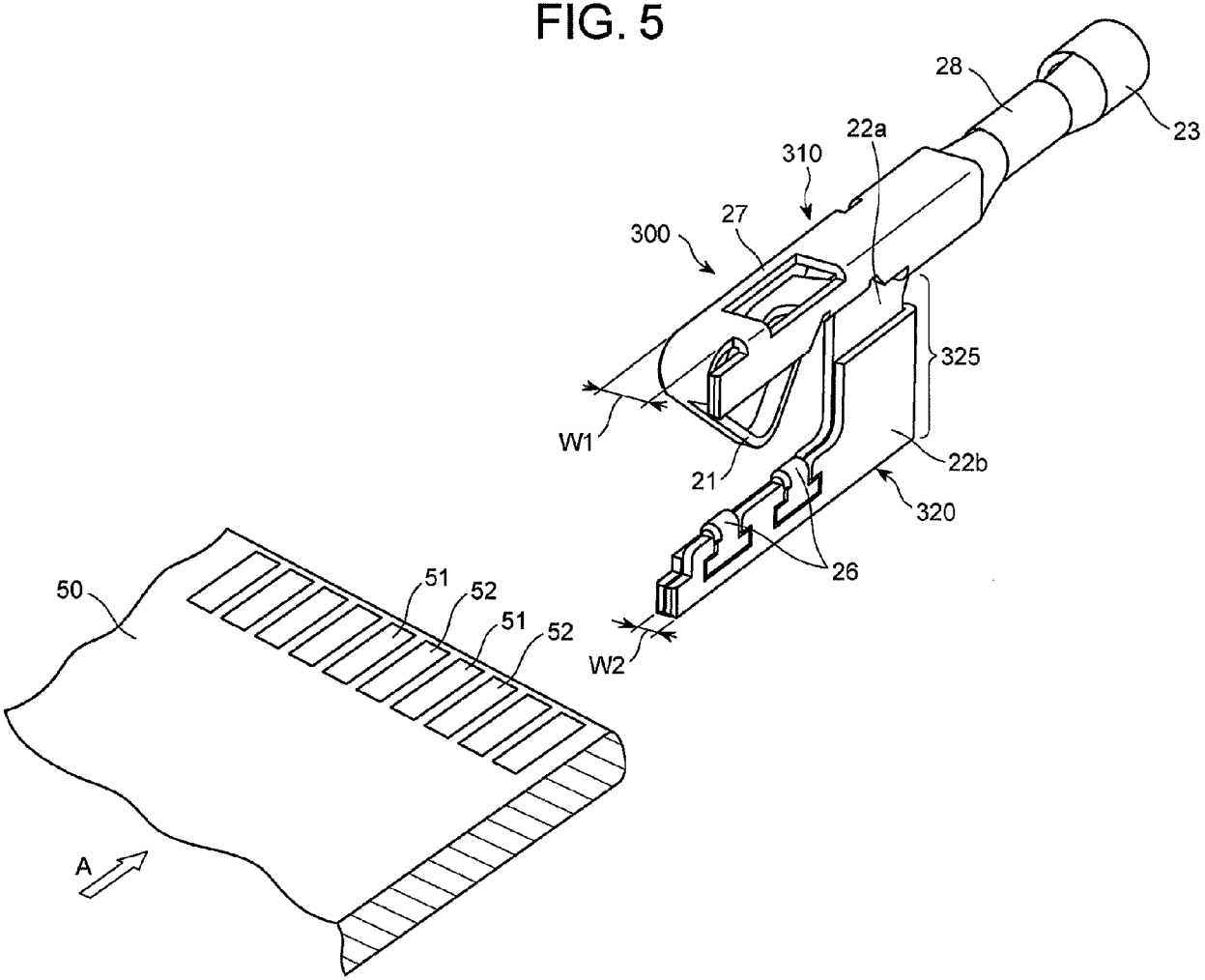
FIG. 5 is a perspective view of the terminal in accordance with the first embodiment of the present invention.

FIG. 5 is a perspective view of the terminal 300 to be connected to a printed circuit board, in accordance with the first embodiment of the present invention.

The terminal 300 sandwiches a printed circuit board 50 through upper and lower surfaces thereof to thereby be electrically connected to the printed circuit board 50.

The printed circuit board 50 is formed at a marginal area on upper and lower surfaces thereof with contact terminals 51 and board-receiving contacts 52 alternately. The board-receiving contacts 52 are formed on a lower surface of the printed circuit board 50 at the same location as that of the contact terminals 51 formed on an upper surface of the printed circuit board 50, and the contact terminals 51 are formed on a lower surface of the printed circuit board 50 at the same location as that of the board-receiving contacts 52 formed on an upper surface of the printed circuit board 50 (see FIG. 6).

The terminal 300 in accordance with the first embodiment includes a first contact part 310 making contact with the contact terminal 51 formed on an upper surface of the printed circuit board 50, and a second contact part 320 making contact with the board-receiving contact 52 formed on a lower surface of the printed circuit board 50.

The first and second contact parts 310 and 320 vertically (that is, a direction perpendicular to the printed circuit board 50) face with each other.

Figure 12:
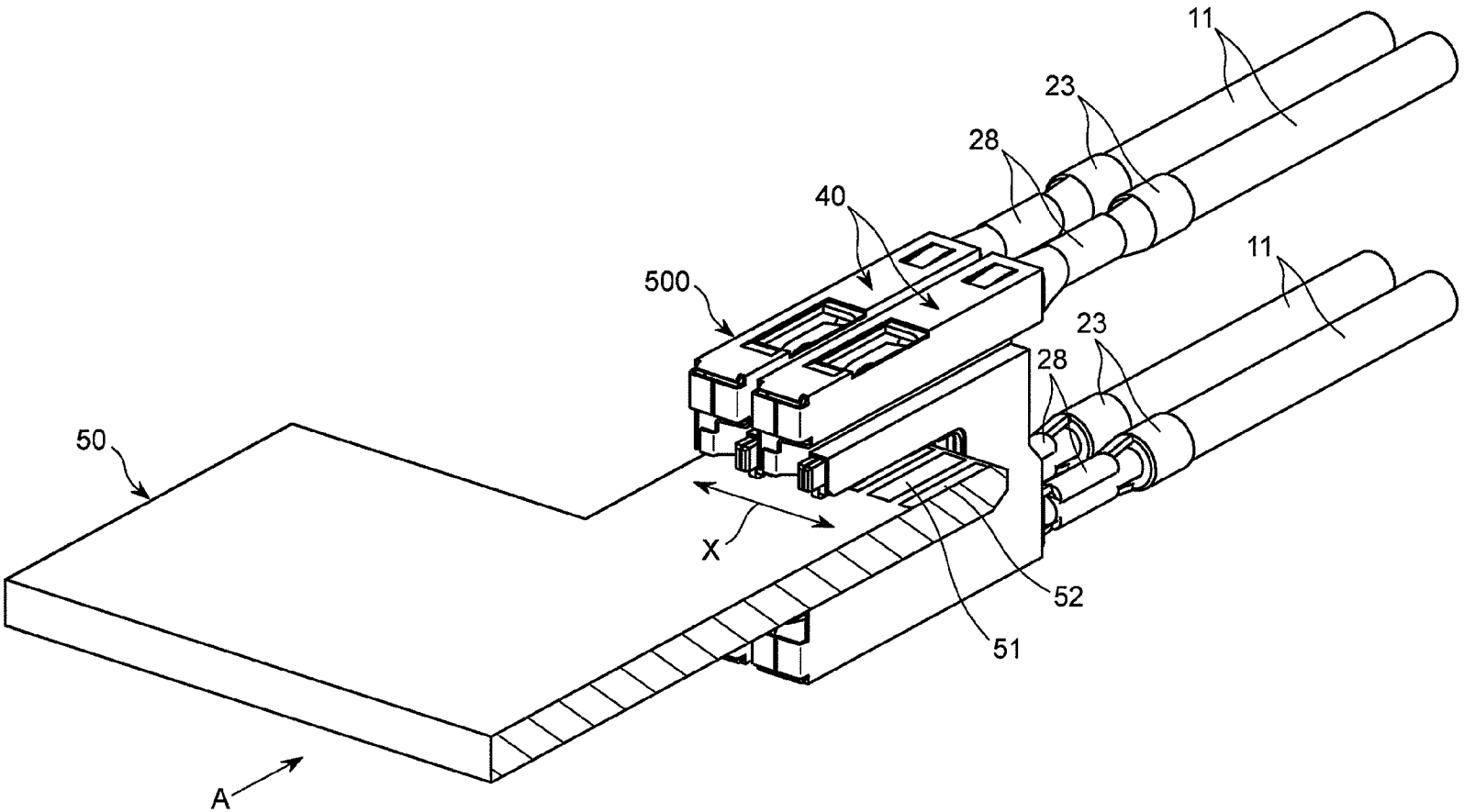
FIG. 12 is a perspective view of the terminals in accordance with the third embodiment of the present invention, connected to a printed circuit board.

The first contact part 310 includes a contact piece 21 making contact with the contact terminal 51 formed on an upper surface of the printed circuit board 50, a support part 27 supporting the contact piece 21, and a cable holder 23 formed at a proximal end of the support part 27 for binding cables 11 (see FIG. 12).

The contact piece 21 is designed to have a width smaller than a width of the support part 27, as mentioned later, and hence, the first contact part 310 is reverse L-shaped when viewed at a front.

The contact piece 21 is attached to a lower surface of the support part 27, and is V-shaped projecting towards the second contact part 320. The contact piece 21 is made of a resilient material, and accordingly, is able to act as a spring.

The second contact part 320 extends almost in parallel with the support part 27, and further, in a vertical plane in which the contact piece 21 also lies. The second part 320 comprises two flat plates 22*a* and 22*b* layered in a plane perpendicular to a plane defined by the printed circuit board 50.

The second contact part 320 is connected at one end thereof with the first contact part 310 through a vertically extending connecting portion 325.

For instance, the second contact part 320 can be formed integrally with the connecting portion 325 by bending a plate composed of phosphor bronze for a spring (C5210) and having a 0.25 mm thickness.

The second contact part 320 is designed to include two receiving contacts 26 spaced away from each other and in facing relation with the contact piece 21.

Figure 6:
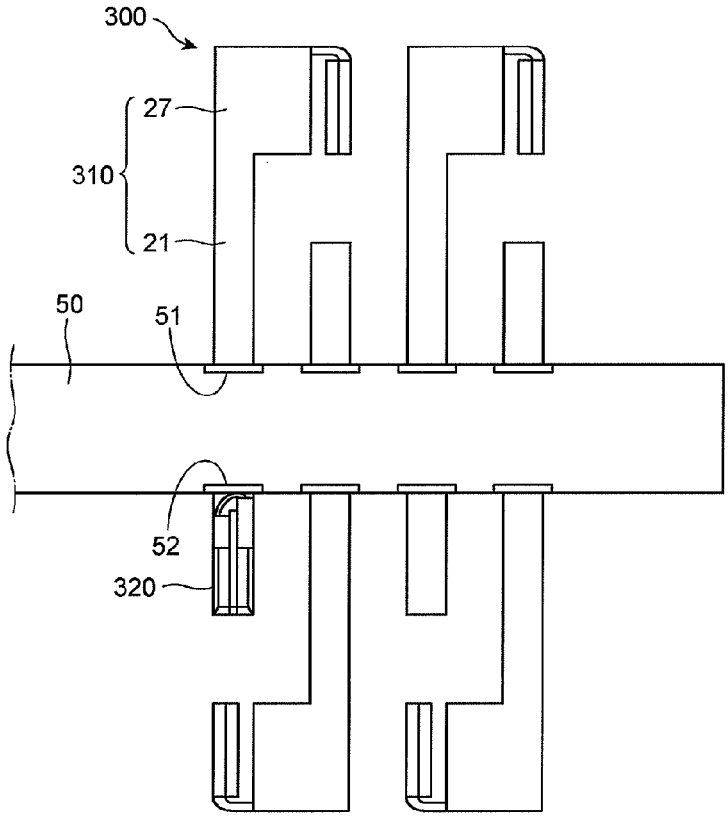
FIG. 6 is a cross-sectional view of the terminals in accordance with the first embodiment of the present invention, sandwiching a printed circuit board therebetween.

FIG. 6 is a cross-sectional view of the terminals 300 each sandwiching the printed circuit board 50 therebetween.

As illustrated in FIG. 6, when the terminal 300 sandwiches the printed circuit board 50 therebetween, the contact piece 21 of the first contact part 310 makes contact with the contact terminal 51 formed on an upper surface of the printed circuit board 50, and the receiving contacts 26 of the second contact part 320 make contact with the board-receiving contact 52 formed on a lower surface of the printed circuit board 50.

While the printed circuit board 50 is being sandwiched between the contact piece 21 and the second contact part 320, an upwardly-directing compressive force is exerted on the contact piece 21. Since the contact piece 21 acts as a spring, the contact piece 21 provides a repulsive force against the compressive force. The repulsive force keeps the printed circuit board 50 sandwiched between the contact piece 21 and the second contact part 320.

Figure 7:
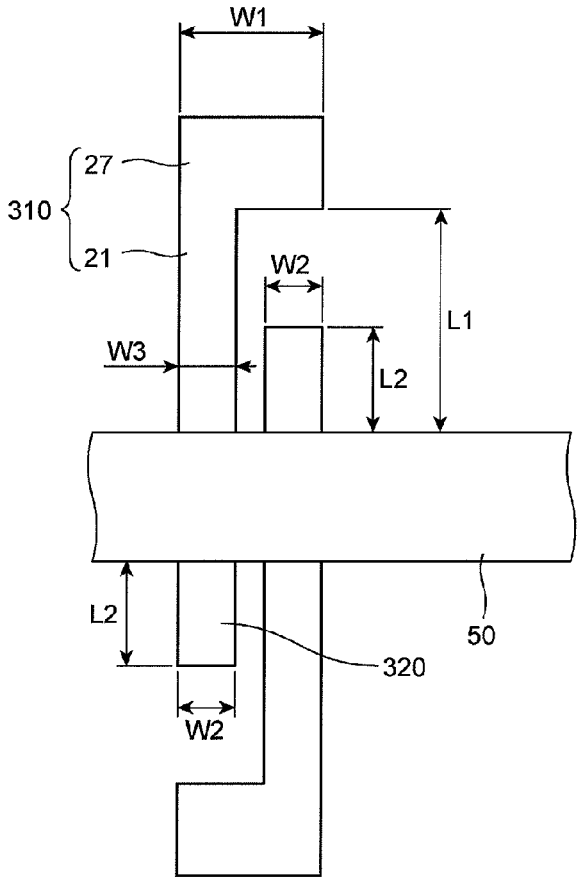
FIG. 7 illustrates a relation among widths and lengths of the support part, the contact piece, and the second contact part in the terminal in accordance with the first embodiment of the present invention.

FIG. 7 illustrates a relation among widths and lengths of the support part 27, the contact piece 21, and the second contact part 320.

As illustrated in FIG. 7, assuming that the support part 27 has a width W1 (a length measured in parallel with a plane defined by the printed circuit board 50, and further, in a direction in which the terminals 300 are aligned), the second contact part 320 has a width W2, the contact piece 21 has a width W3, the contact piece 21 has a vertical length L1 (a length measured in a direction perpendicular to a plane defined by the printed circuit board 50), and the second contact part 320 has a vertical length L2, the widths and lengths are determined as follows in the terminal 300 in accordance with the first embodiment.

The contact piece 21 is designed to have a width W3 smaller than a width W1 of the support part 27.

$$W3<W1$$

The second contact part 320 is designed to have a width W2 smaller than a width W1 of the support part 27.

$$W2<W1$$

The contact piece 21 is designed to have a length L1 greater than a length L2 of the second contact part 320.

$$L1>L2$$

Furthermore, the second contact part 320 is designed to have a width W2 smaller than a difference between a width W1 of the support part 27 and a width W3 of the contact piece 21.

$$W2<W1-W3$$

The second contact part 320 is designed to have a width W2 equal to a width W3 of the contact piece 21.

$$W2=W3$$

Since the widths and the lengths of the support part 27, the contact piece 21 and the second contact part 320 are determined as mentioned above, as illustrated in FIG. 6, when the first terminal 300 is connected to the printed circuit board 50 such that the first contact part 310 is situated above an upper surface of the printed circuit board 50, and further, the second terminal 300 is connected to the printed circuit board 50 adjacent to the first terminal 300 such that the second contact part 320 is situated above an upper surface of the printed circuit board 50, the second contact part 320 of the second terminal 300 does not interfere with the first contact part 310 of the first terminal 300.

The terminal 300 in accordance with the first embodiment provides advantages as follows.

The terminal 300 in accordance with the first embodiment makes it possible to arrange two terminals 300 within a width W1 of the support part 27 which is a maximum width in the terminal 300. Accordingly, the contact terminal 51 and the board-receiving contact 52 can be formed on the printed circuit board 50 at a reduced pitch. In other words, it is possible to increase a number of the terminals 300 to be connected to the printed circuit board 50.

Furthermore, since the second contact part 320 has a multi-layered structure including the two plates 22*a* and 22*b* in the terminal 300 in accordance with the first embodiment, when the terminal 300 is connected to the printed circuit board 50, it is possible to enhance rigidity of the second contact part 320 against a compressive force acting on the second contact part 320 due to the resilient force caused by the contact piece 21, and hence, it is possible to generate a stable contact pressure to the contact terminal 51 and the board-receiving contact 52 of the printed circuit board 50, ensuring excellent contact reliability.

The structure of the terminal 300 is not to be limited to the above-mentioned one, but may be designed to include various alternatives, modifications and equivalents.

For instance, the contact piece 21 is designed to have a width W3 equal to a width W2 of the second contact part 320 (W2=W3) in the terminal 300 in accordance with the first embodiment, a width W3 may be designed smaller than a width W2 (W3<W2). As an alternative, a width W2 may be designed smaller than a width W3 (W2<W3).

The second contact part 320 is designed to have a width W2 smaller than a difference between a width W1 of the support part 27 and a width W3 of the contact piece 21 (W2<W1−W3) in the terminal 300 in accordance with the first embodiment, a width W2 may be designed smaller than a half of a width W1.

$$W2<W1/2$$

By so designing the widths W1 and W2, the contact piece 21 and the second contact part 320 can be situated adjacent to each other with sufficient margin therebetween.

In the terminal 300 in accordance with the first embodiment, the second contact part 320 has a two-layered structure of the two plates 22*a* and 22*b*. The second contact part 320 may be designed to have a N-layered structure wherein N is an integer equal to or greater than three (3). It should be noted that if the contact terminal 51 and the board-receiving contact 52 can be arranged at a relatively wide pitch on the printed circuit board 50, the second contact part 320 may be comprised of a single flat plate, in which case, it is not necessary for the second contact part 320 to have a multi-layered structure.

The contact piece 21 is designed to be V-shaped in the terminal 300 in accordance with the first embodiment. As an alternative, the contact piece 21 may be designed to be of other shapes such as U-shaped, J-shaped or semicircular.

Though the second contact part 320 is designed to include the two receiving contacts 26, a number of the receiving contacts 26 is not to be limited to two (2). The second contact part 320 may be designed to include one or three or more receiving contacts 26.

Furthermore, a cross-sectional section of the receiving contacts 26 is not to be limited to a semicircular one, but may be designed to be other curved shapes.

Second Embodiment

Figure 8:
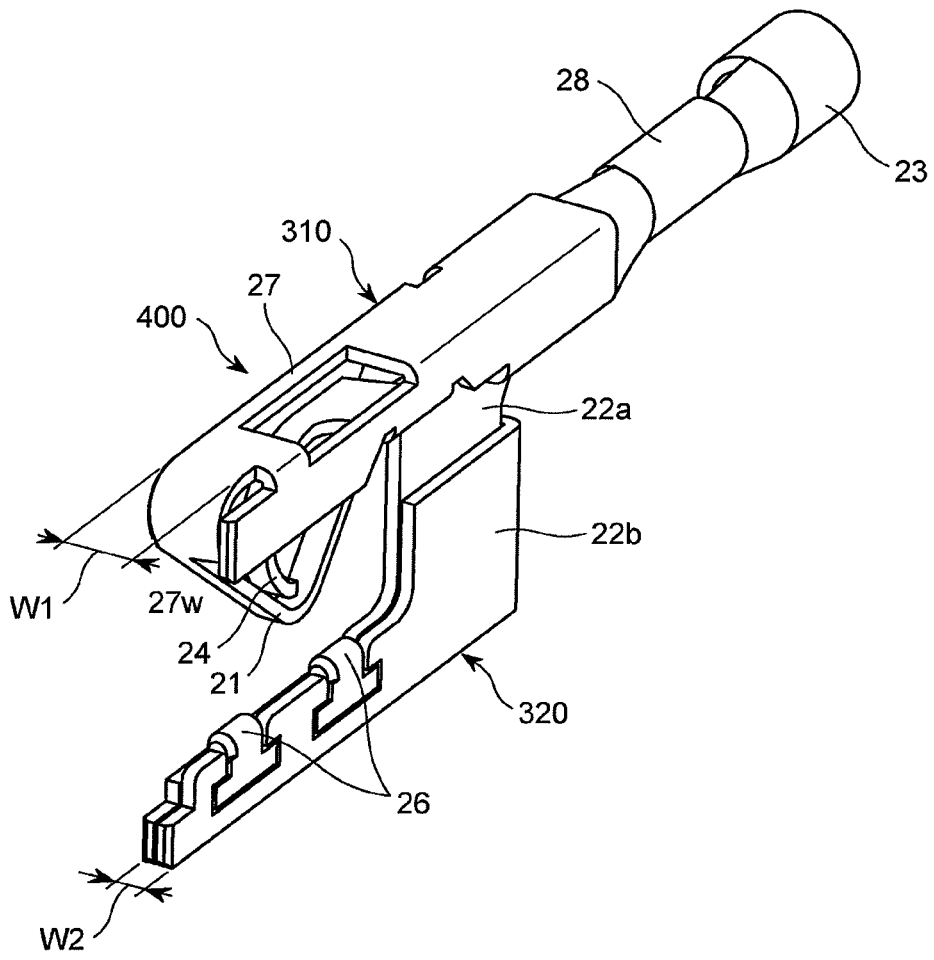
FIG. 8 is a perspective view of the terminal in accordance with the second embodiment of the present invention.

FIG. 8 is a perspective view of the terminal 400 in accordance with the second embodiment of the present invention.

The terminal 400 is designed to additionally include a subsidiary spring 24 in comparison with the terminal 300 in accordance with the first embodiment.

The subsidiary spring 24 is J-shaped, and is housed within the V-shaped contact piece 21 such that a distal end of the subsidiary spring 24 makes touch with an inner wall of the contact piece 21.

By arranging the subsidiary spring 24 within the contact piece 21, when the printed circuit board 50 is sandwiched between the contact piece 21 and the second contact part 320, a repulsive force caused by the subsidiary spring 24 is added to a repulsive force caused by the contact piece 21, it is possible for the printed circuit board 50 to be surely sandwiched between the contact piece 21 and the second contact part 320.

Third Embodiment

Figure 9:
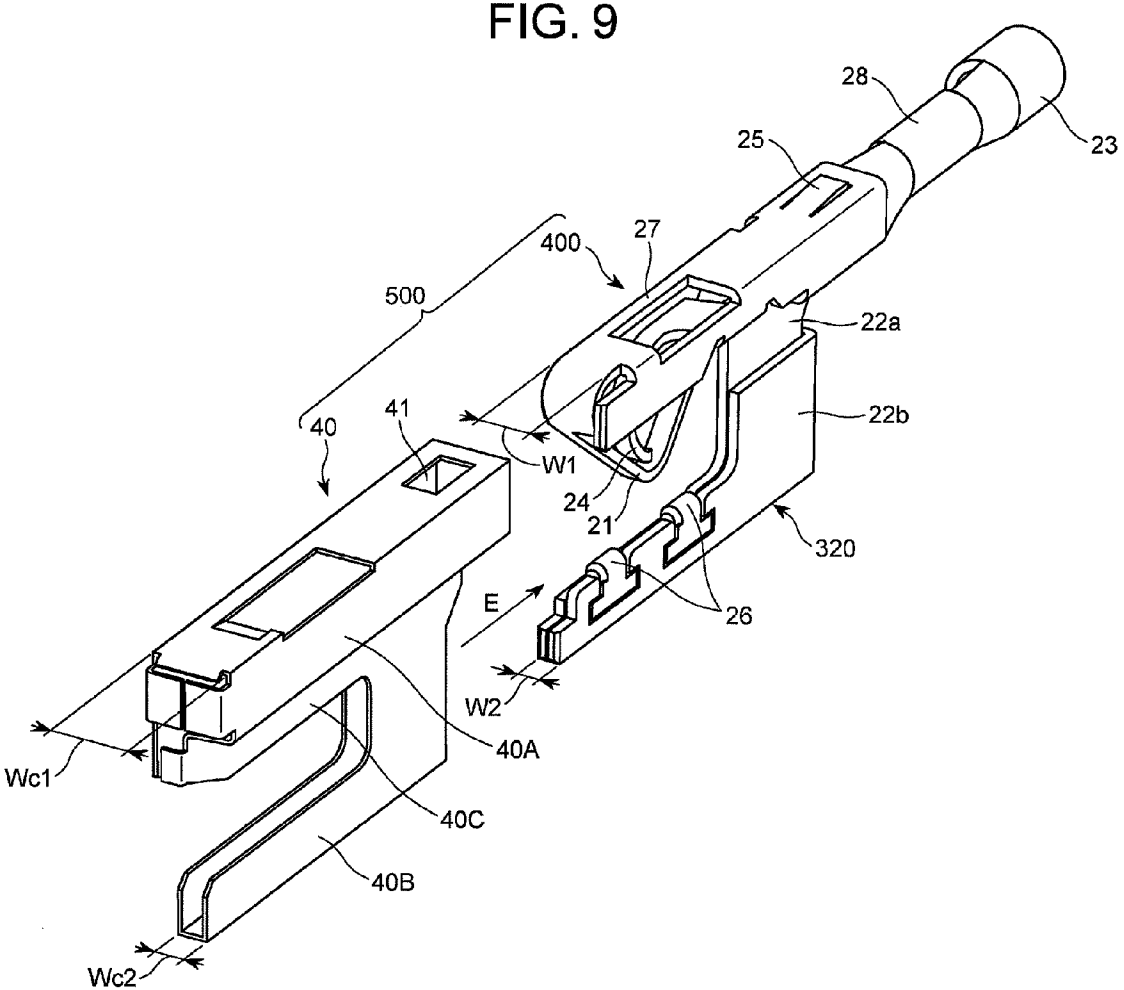
FIG. 9 is an exploded perspective view of the terminal in accordance with the third embodiment of the present invention.

FIG. 9 is an exploded perspective view of the terminal 500 in accordance with the third embodiment of the present invention.

The terminal 500 is designed to additionally include a cover 40 relative to the terminal 400 in accordance with the second embodiment.

Figure 10:
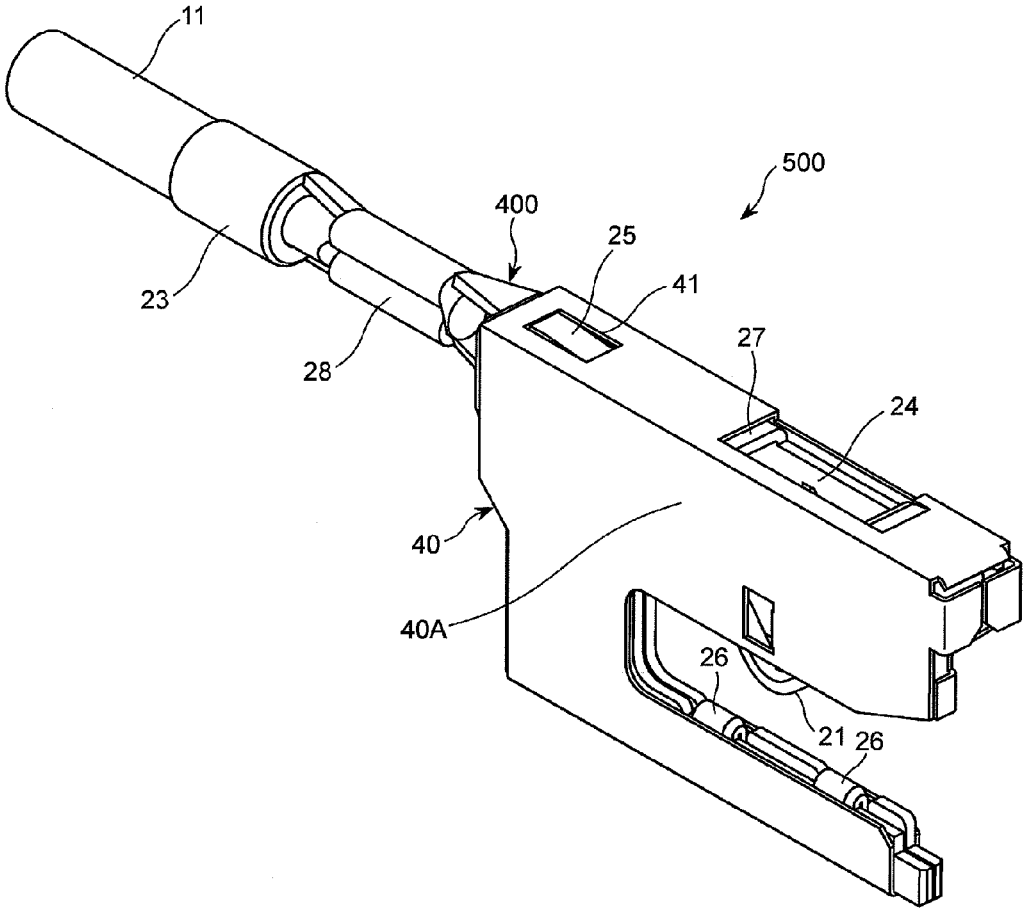
FIG. 10 is a perspective view of the terminal in accordance with the third embodiment of the present invention, viewing from the left.
Figure 11:
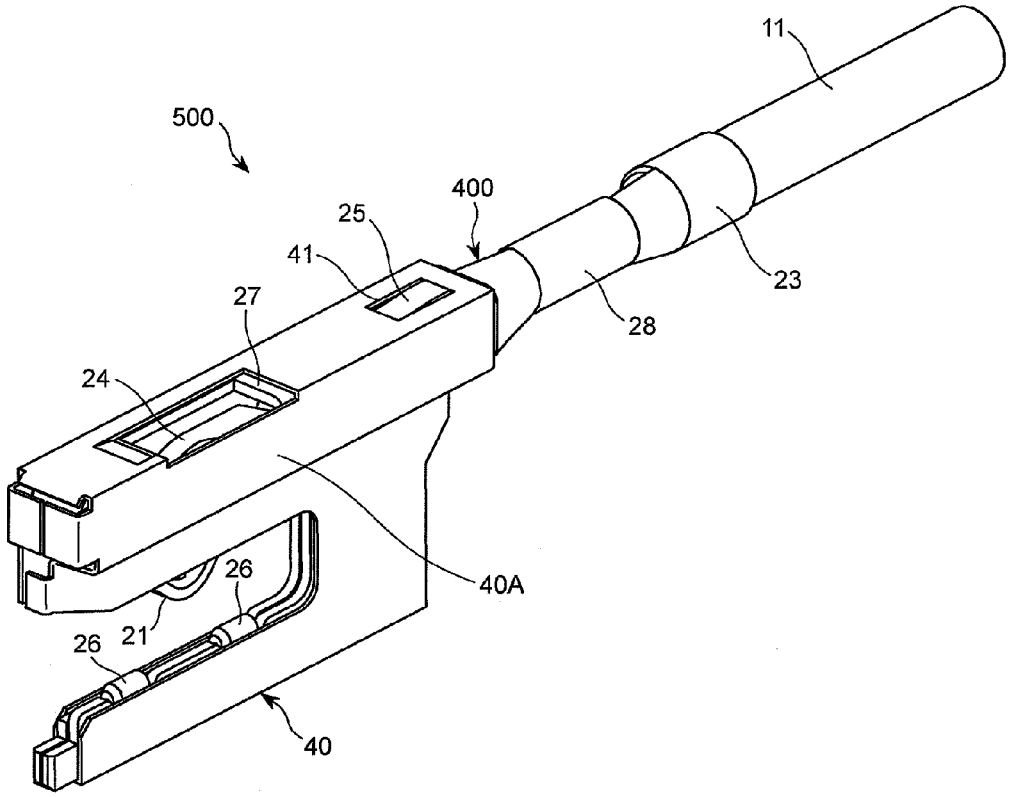
FIG. 11 is a perspective view of the terminal in accordance with the third embodiment of the present invention, viewing from the right.
Figure 13:
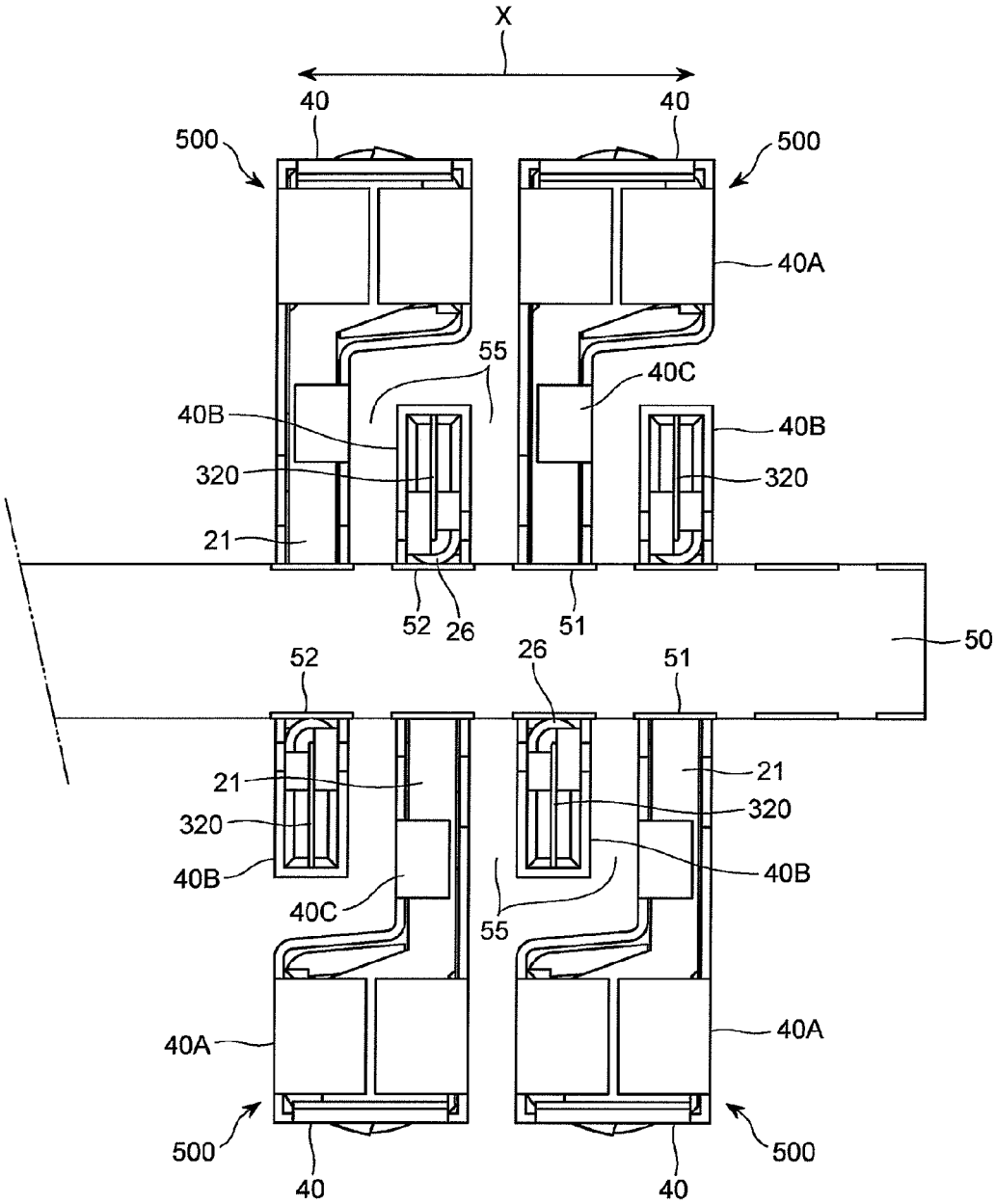
FIG. 13 is a cross-sectional view of the terminals in accordance with the third embodiment of the present invention, sandwiching a printed circuit board therebetween.

FIG. 10 is a perspective view of the terminal 500 including the cover 40, viewing from the left, and FIG. 11 is a perspective view of the same, viewing from the right. FIG. 12 is a perspective view of a plurality of the terminals 500 connected to the printed circuit board 50, and FIG. 13 is a cross-sectional view of the terminals 500 sandwiching the printed circuit board 50 therebetween.

The cover 40 has a shape so as to be able to cover the support part 27 of the first contact part 310, the connecting portion 325, and the second contact part 320 therewith. As illustrated in FIGS. 10 and 11, when the cover 40 is attached to the terminal 400, a distal end of the contact piece 21 and summits of the receiving contacts 26 are exposed out of the cover 40. Accordingly, when the printed circuit board 50 is sandwiched between the contact piece 21 and the second contact part 320, the cover 40 dose not interfere with the printed circuit board 50.

The cover 40 is formed at an upper surface with a rectangular engagement opening 41. The support part 27 is formed at an upper surface with an engagement hook 25.

The cover 40 is open at a rear thereof. As indicated with an arrow E in FIG. 9, the cover 40 is attached to the terminal 400 by inserting the cover 40 into the support part 27 and the second contact part 320, and engaging the engagement hook 25 to the engagement opening 41.

For instance, the cover 40 can be formed by bending a stainless steel plate having a thickness of 0.1 mm.

Assuming a portion of the cover 40 which covers the support part 27 is named a first cover portion 40A, a portion of the cover 40 which covers the second contact part 320 is named a second cover portion 40B, and a portion of the cover 40 which covers the contact piece 21 is named a third cover portion 40C, as illustrated in FIGS. 10 to 12, the first cover portion 40A, the second cover portion 40B and the third cover portion 40C are designed to make close contact with the first contact part 310, the second contact part 320 and the contact piece 21, respectively. Specifically, the first cover portion 40A makes surface-contact with opposite side surfaces of both the support part 27 and the contact piece 21, the second cover portion 40B makes surface-contact with opposite side surfaces of the second contact part 320, and the third cover portion 40C makes surface-contact with opposite side surfaces of the contact piece 21.

Figure 14:
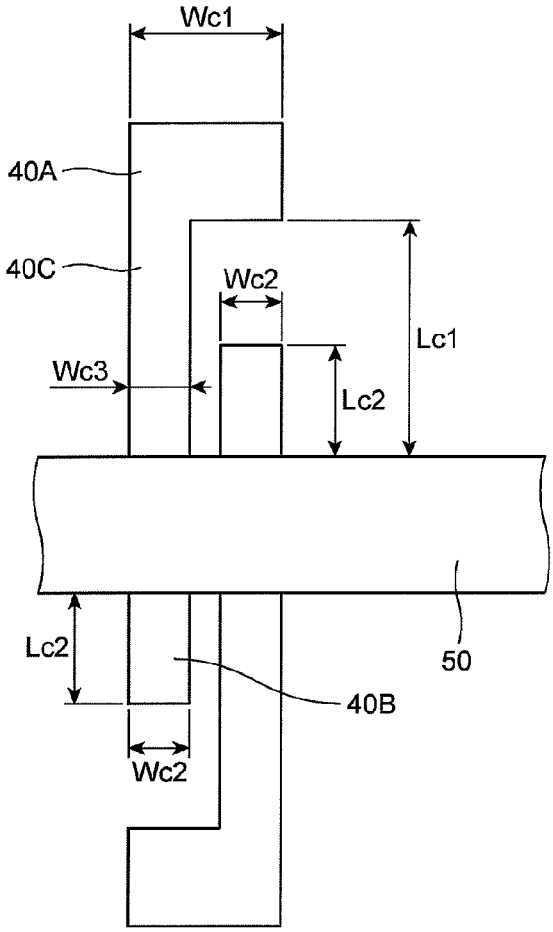
FIG. 14 illustrates a relation among widths and lengths of the first cover portion, the second cover portion, and the third cover portion in the terminal in accordance with the third embodiment of the present invention.

FIG. 14 illustrates a relation among widths and lengths of the first cover portion 40A, the second cover portion 40B, and the third cover portion 40C.

As illustrated in FIG. 14, assuming that the first cover portion 40A has a width W*c*1 (a length measured in parallel with a plane defined by the printed circuit board 50, and in a direction in which the terminals 500 are arranged), the second cover portion 40B has a width W*c*2, the third cover portion 40C has a width W*c*3, the third cover portion 40C has a vertical length L*c*1 (a length measured in a direction perpendicular to a plane defined by the printed circuit board 50), and the second cover portion 40B has a vertical length L*c*2, those are determined as follows.

The third cover portion 40C is designed to have the width W*c*3 smaller than the width Wc1 of the first cover portion 40A.

$$Wc3<Wc1$$

The second cover portion 40B is designed to have the width W*c*2 smaller than the width W*c*1 of the first cover portion 40A.

$$Wc2<Wc1$$

The third cover portion 40C is designed to have the length L*c*1 greater than the length L*c*2 of the second cover portion 40B.

$$Lc1>Lc2$$

Furthermore, the second cover portion 40B is designed to have the width W*c*2 smaller than a difference between the width W*c*1 of the first cover portion 40A and the width W*c*3 of the third cover portion 40C.

$$Wc2<Wc1-Wc3$$

The second cover portion 40B is designed to have the width Wc2 equal to the width Wc3 of the third cover portion 40C.

$$Wc2=Wc3$$

Since the widths and the lengths of the first cover portion 40A, the second cover portion 40B and the third cover portion 40C are determined as mentioned above, as illustrated in FIG. 13, when the first terminal 500 is connected to the printed circuit board 50 such that the first cover portion 40A is situated above an upper surface of the printed circuit board 50, and further, the second terminal 500 is connected to the printed circuit board 50 adjacent to the first terminal 500 such that the second cover portion 40B is situated above an upper surface of the printed circuit board 50, the second cover portion 40B of the second terminal 500 does not interfere with the first and third cover portions 40A and 40C of the first terminal 500.

That is, similar to the terminal 300 in accordance with the first embodiment, it is possible to arrange two terminals 500 within the width W*c*1 of the first cover portion 40A which is a maximum width in the terminal 500.

The width W*c*1 of the first cover portion 40A, the width W*c*2 and the length L*c*2 of the second cover portion 40B, and the width W*c*3 and the length L*c*1 of the third cover portion 40C may be changed in the same manner as the widths and the lengths of the support part 27, the second contact part 320 and the contact piece 21 in the first embodiment.

Furthermore, in the terminal 500 in accordance with the third embodiment, since the first cover portion 40A is designed to make surface-contact with opposite side surfaces of both the support part 27 and the contact piece 21, and the second cover portion 40B is designed to make surface-contact with opposite side surfaces of the second contact part 320, it is possible to reinforce the support part 27 and the second contact part 320 with the first cover portion 40A and the second cover portion 40B, respectively, making it possible that the second contact part 320 can have increased rigidity, which ensures enhancement in contact reliability.

It is quite effective to attach the cover 40 to the terminal 400, if the contact terminals 51 and the board-receiving contacts 52 are arranged at a relatively small pitch on the printed circuit board 50, and hence, the second 15 contact part 320 cannot have a sufficient thickness.

As illustrated in FIG. 10, since a cable compressive section 28 forms about 90 degrees angle relative to the support part 27, the cable 11 can be compressed in a width-wise direction W1 of the support part 27. This ensures it possible to lower a height at which the terminal 400 is fixed in a step such as a step for connecting the terminal 400 to a printed circuit board, ensuring enhancement of workability.

Hereinbelow is explained an example of actual use of the terminal 500 with reference to FIGS. 15 to 19.

Figure 15:
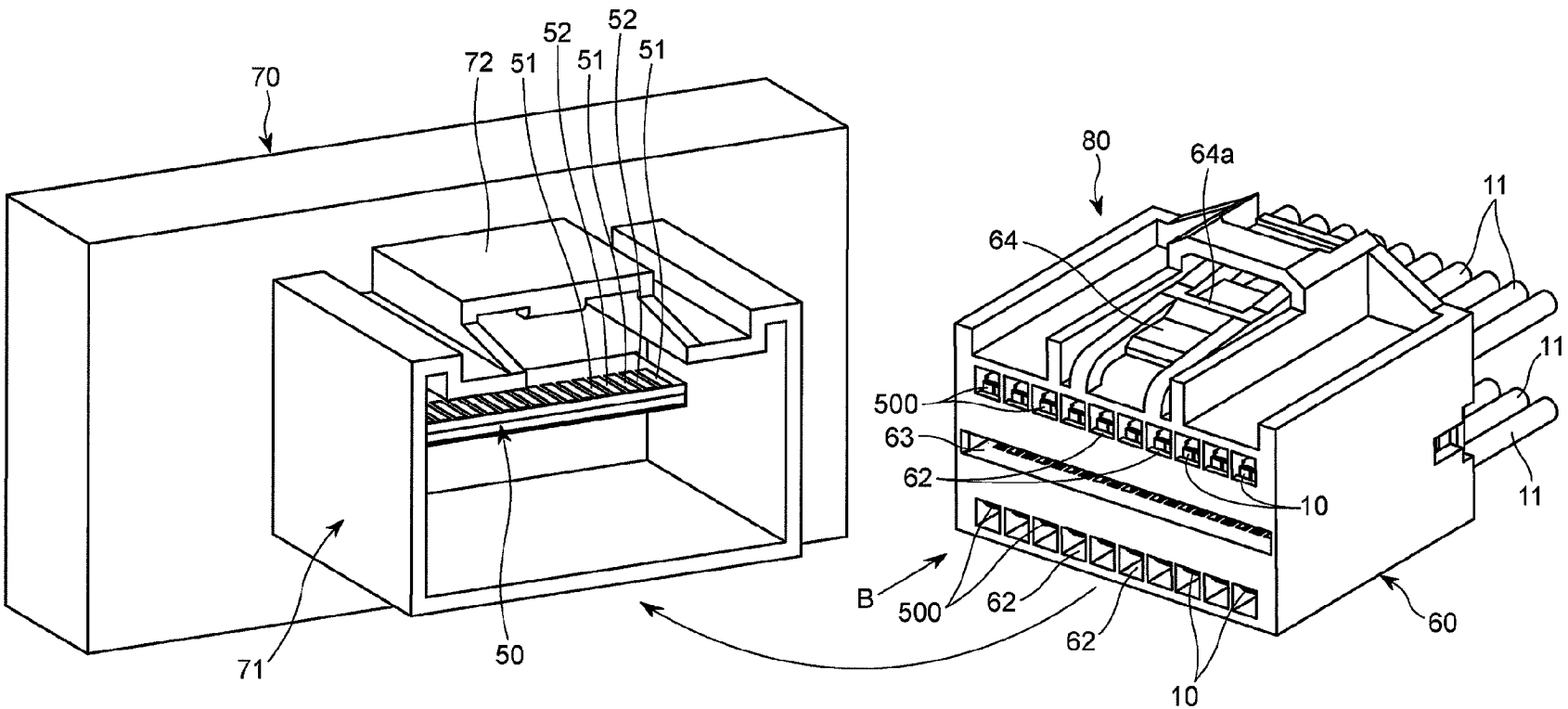
FIG. 15 is a perspective view an example of actual use of the terminal in accordance with the third embodiment of the present invention.
Figure 16:
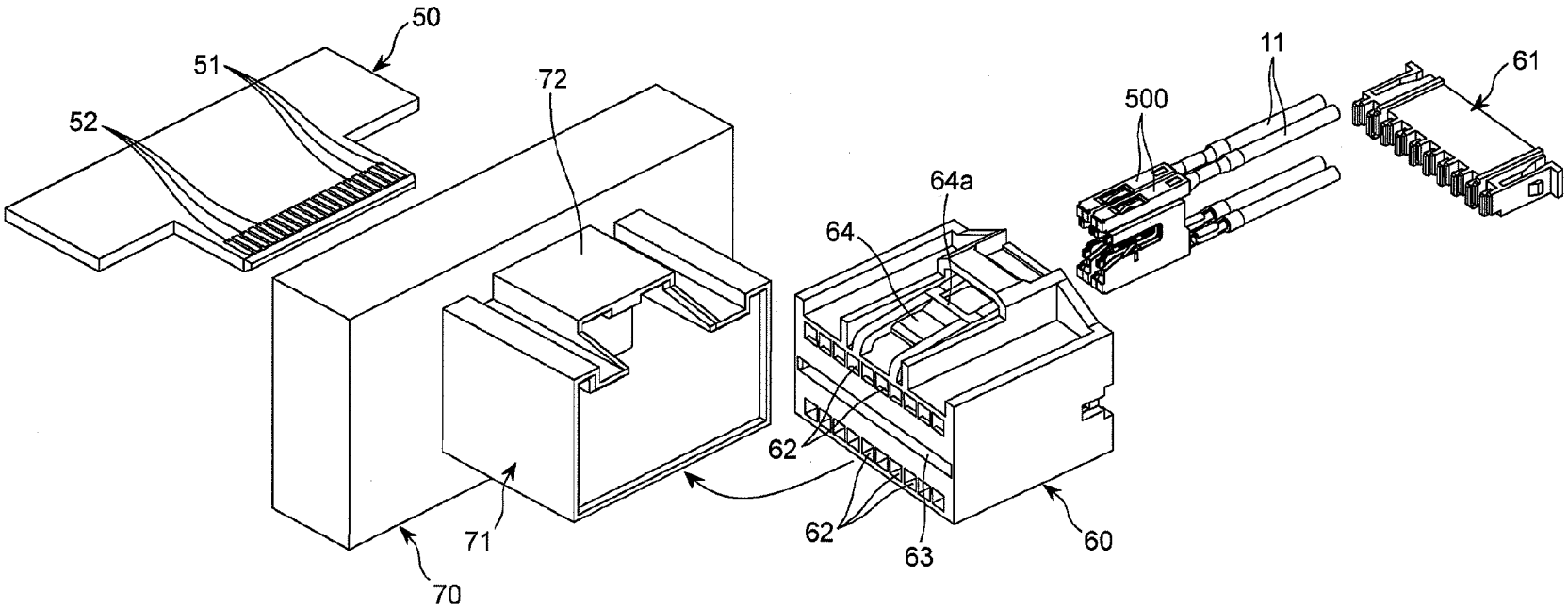
FIG. 16 is an exploded perspective view of the example illustrated in FIG. 15.
Figure 17:
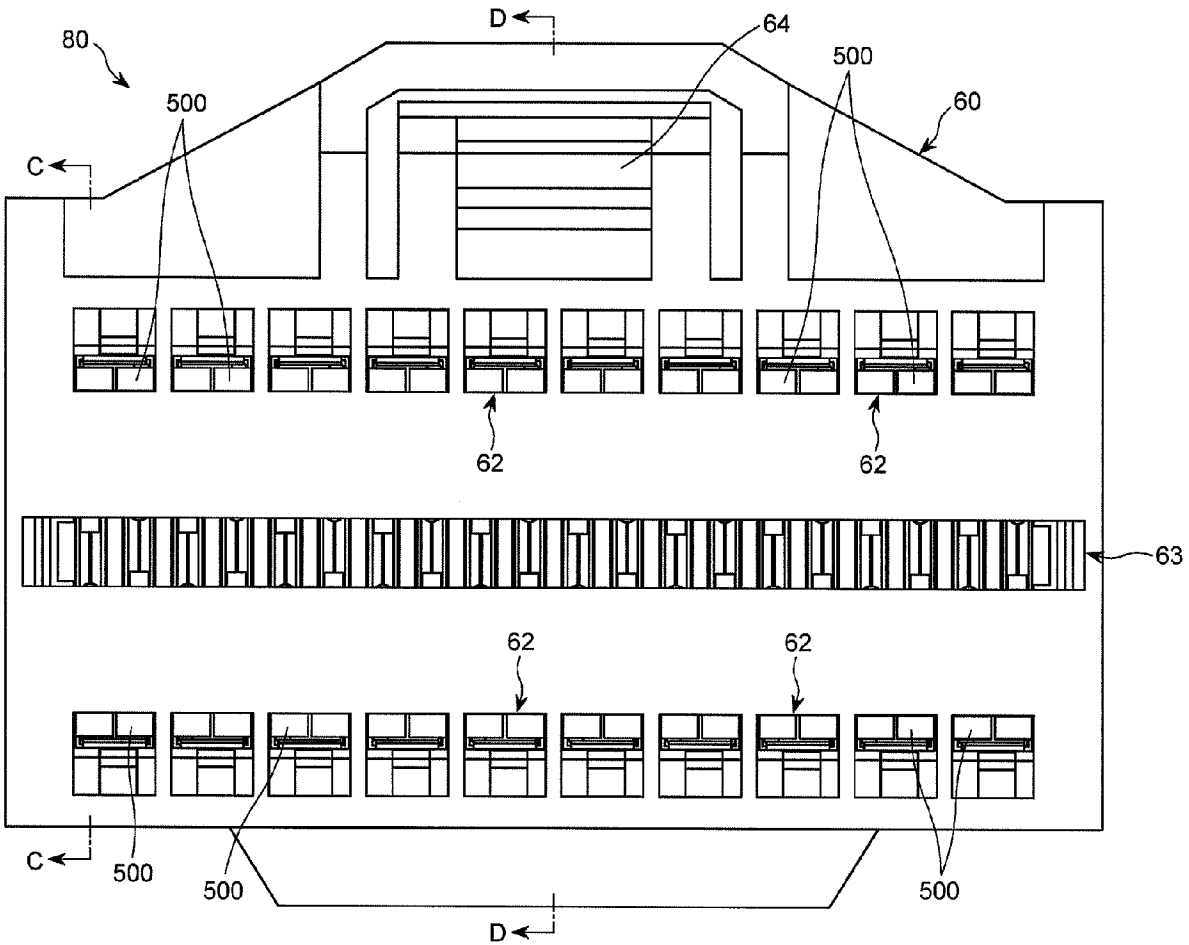
FIG. 17 is a front view of the female housing, viewing in a direction of the arrow B shown in FIG. 15.
Figure 18:
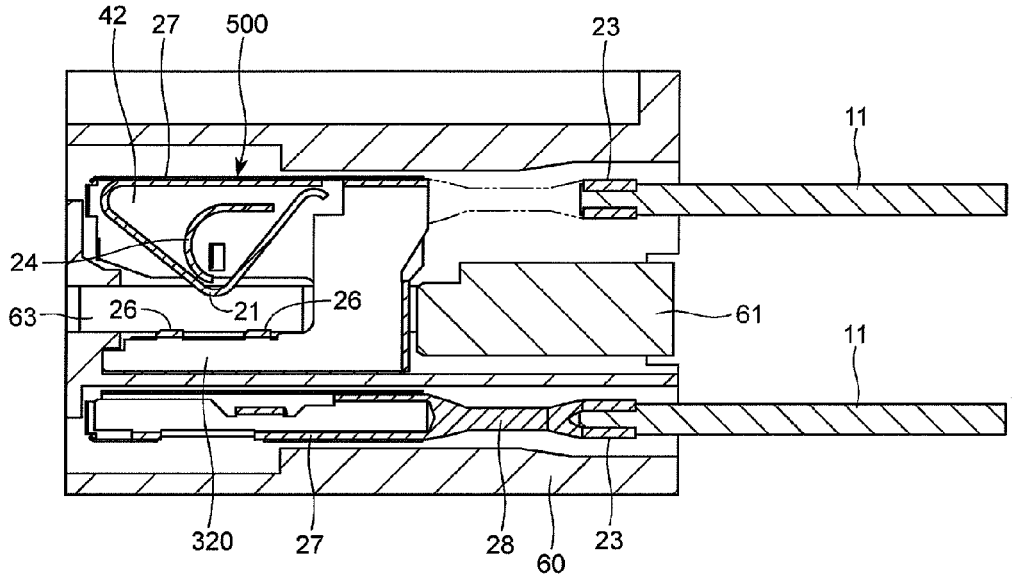
FIG. 18 is a cross-sectional view taken along the line C-C in FIG. 17.
Figure 19:
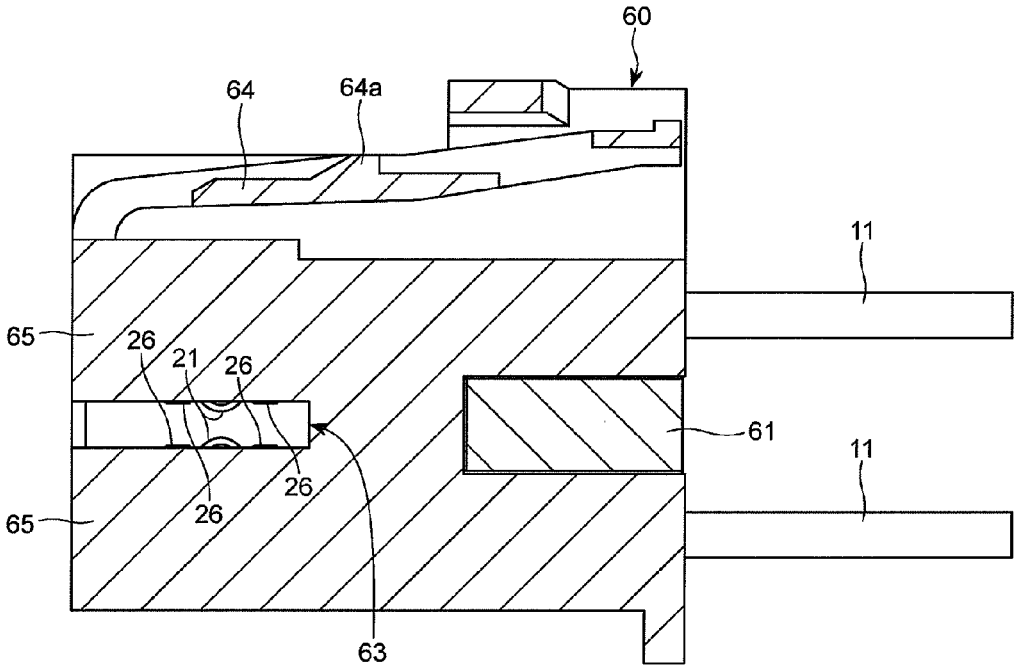
FIG. 19 is a cross-sectional view taken along the line D-D in FIG. 17.

FIG. 15 is a perspective view an example of actual use of the terminal 500, and FIG. 16 is an exploded perspective view of the example illustrated in FIG. 15. FIG. 17 is a front view, viewing in a direction of the arrow B shown in FIG. 15, FIG. 18 is a cross-sectional view taken along the line C-C in FIG. 17, and FIG. 19 is a cross-sectional view taken along the line D-D in FIG. 17.

As illustrated in FIGS. 15 and 16, a plurality of the terminals 500 is inserted into a female housing 60 through a rear, and arranged therein at a constant pitch. The terminals 500 are fixed there by means of a retainer 61 (see FIGS. 18 and 19) inserted into the female housing 60 through a rear. Thus, the female housing 60 and a plurality of the terminals 500 cooperate with each other to define a connector 80 (see FIG. 15).

In the connector 80, partition walls 65 (see FIG. 19) each comprising a thin plate and defining a part of the female housing 60 are inserted into spaces 55 (see FIG. 13) formed between the terminals 500 situated adjacent to each other. The partition walls 65 prevent the adjacent terminals 500 from interfering with each other.

The female housing 60 is formed with a plurality of through-holes 62 through which the terminals 500 are inserted through a rear of the female housing 60, and an opening 63 through which the printed circuit board 50 is inserted thereinto through a front of the female housing 60. The female housing 60 is formed at an upper surface thereof with a lock arm 64 having an engagement hook 64*a*.

A male housing 70 is formed at a rear thereof with a housing 71 into which the female housing 60 is inserted. A marginal portion (an area in which the contact terminals 51 and the board-receiving contacts 52 are arranged) of the printed circuit board 50 inserted into the male housing 70 through a front extends in the housing 71.

The housing 71 is formed at an upper surface thereof with a lock-arm receiver 72.

As illustrated in FIG. 15, the female housing 60 is inserted through a front thereof into the housing 71 such that the contact terminals 51 and the board-receiving contacts 52 of the printed circuit board 50 are inserted into the opening 63 of the female housing 60. The lock arm 64 of the female housing 60 is inserted into the lock-arm receiver 72 of the male housing 70, and then, the engagement hook 64*a* is made engaged to the lock-arm receiver 72. Thus, the connector 80 and the printed circuit board 50 are mechanically and electrically connected to each other.

INDUSTRIAL APPLICABILITY

The terminal in accordance with the present invention can be used in various fields such as electrical and electronic fields and a field of an automobile, as a part of a connector electrically connecting an electrically conductive cable with a contact terminal of a printed circuit board.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2011-178721 filed on Aug. 18, 2011 including specification, claims, drawings and summary is incorporated herein by reference in its entirety.

What is claimed is:

1. A terminal adapted to be connected to a printed circuit board by sandwiching said printed circuit board therebetween at upper and lower surfaces of said printed circuit board, comprising:

a first contact part making contact with a first contact area formed at an upper surface of said printed circuit board; and a second contact part making contact with a second contact area formed at a lower surface of said printed circuit board, said second contact part being in facing relation with said first contact part, said first contact part comprising a resilient contact piece making contact with said first contact area, and a support part for supporting said contact piece, said contact piece having a width smaller than a width of said support part, and said second contact part having a width smaller than a width of said support part, said contact piece having a length greater than a length of said second contact part, said lengths being measured in a direction perpendicular to a plane defined by said printed circuit board.

2. The terminal as set forth in claim 1, wherein said contact piece has a width equal to a width of said second contact part.

3. The terminal as set forth in claim 1, wherein said second contact part has a width smaller than a difference between a width of said support part and a width of said contact piece.

4. The terminal as set forth in claim 3, wherein said contact piece has a width equal to a width of said second contact part.

5. The terminal as set forth in claim 1, wherein said second contact part comprises a plurality of plates layered in a plane perpendicular to said printed circuit board.

6. The terminal as set forth in claim 1, wherein said contact piece is V-shaped, projecting towards said second contact part.

7. The terminal as set forth in claim 6, further comprising a subsidiary spring situated inside of said contact piece for actuating said contact piece towards said second contact part.

8. The terminal as set forth in claim 1, wherein said second contact part includes at least one contact having an upper surface having a semi-circular cross-section.

9. The terminal as set forth in claim 1, further comprising a cover covering said first and second contact parts therewith.

10. The terminal as set forth in claim 9, wherein said cover makes surface-contact at least with opposite side surfaces of said second contact part.

11. The terminal as set forth in claim 9, wherein said cover includes a first cover portion covering said support part of said first contact part therewith, and a second cover portion covering said second contact part therewith, said second cover portion has a width smaller than a width of said first cover portion, and a portion of said cover covering said contact piece has a width equal to a width of said second cover portion.

12. The terminal as set forth in claim 9, wherein said cover includes a first cover portion covering said support part of said first contact part therewith, and a second cover portion covering said second contact part therewith, said second cover portion has a width smaller than a width of said first cover portion, and said second covering portion has a width smaller than a difference between a width of said first cover portion and a width of a portion of said cover covering said contact piece.

13. The terminal as set forth in claim 12, wherein said portion of said cover covering said contact piece has a width equal to a width of said second cover portion.

14. The terminal as set forth in claim 1, further comprising a cable compressive section in which a cable is held in a compressed condition in a width-wise direction of said support part.

15. A connector comprising:

a terminal as set forth in claim 1; and a housing including therein a plurality of said terminals.

* * * * *